United States Patent [19]

Ouellette, Jr.

[11] Patent Number: 5,025,713

[45] Date of Patent: Jun. 25, 1991

[54] TEMPORARY GRATE COVER ESPECIALLY ADAPTED FOR PAINT SPRAY BOOTH AREAS

[75] Inventor: Thomas C. Ouellette, Jr., Kalamazoo, Mich.

[73] Assignee: Apollo Manufacturing Corporation, Kalamazoo, Mich.

[21] Appl. No.: 598,541

[22] Filed: Oct. 16, 1990

[51] Int. Cl.[5] ..... B05B 15/12

[52] U.S. Cl. ..... 98/115.2; 118/326

[58] Field of Search ..... 98/115.2; 118/326, 634, 118/DIG. 7; 126/25 R

[56] References Cited

U.S. PATENT DOCUMENTS 4,770,089 9/1988 Vinicombe ..... 98/115.2

*Primary Examiner*—Harold Joyce

*Attorney, Agent, or Firm*—Gordon W. Hueschen

[57] ABSTRACT

A cover for a paint spray area grate having parallel grate blades and parallel grate cross members. The cover is provided with built-in protuberances in skirt members which lock or clamp the cover to grate cross members and with skirts which extend below the lower edge of the grate blades.

9 Claims, 3 Drawing Sheets

TEMPORARY GRATE COVER ESPECIALLY ADAPTED FOR PAINT SPRAY BOOTH AREAS

INTRODUCTION

This invention relates to a further improvement in covers for temporary use in protecting grates in paint spray areas of the type in which air is directed down through the grates in the floor area thereof to direct, remove, and collect excess spray paint therefrom.

BACKGROUND OF THE INVENTION

Prior Art

Covers suitable for temporary use in protecting grates in paint spray areas of a kind in which air is directed down through the grates in the floor area thereof to direct, remove, and collect excess spray paint therefrom, are known in the art.

The prior art is well summarized in U.S. Pat. No. 4,770,089, issued Sept. 13, 1988, the disclosure of which patent is referred to herein and by reference made a part hereof.

The present invention is of the same type as disclosed and claimed in U.S. Pat. No. 4,770,089, but provides a grate having certain unique structural characteristics and features which in turn provide certain operating advantages which did not characterize prior art structures, including the structure of U.S. Pat. No. 4,770,089.

In particular, the grate covers of that invention have been found in practice not to adhere adequately or securely to the grates intended to be covered thereby and, in fact, even when clips were provided, as disclosed in that previous patent, the tendency of the cover to lift off of the grate during use not only frustrated the objectives of the grate cover but indeed militated against its use in the paint spray area. Additionally, even when retaining clips were employed together with such prior-art structures, they existed as a separate unit and required separate and additional effort and care for their proper installation and still did not provide a fail-safe way to positively block lifting of the cover off of the grate, a feature which is provided according to the present invention by the employment of built-in protuberances on skirts which press against a portion of the underside of the grate cross members. In addition, in practice it has been found that the lower edges of the skirt members must be located below the bottom edges of the underlying grate blades to prevent undue collection of paint particles and the like, not only upon the lower edges of the grate blades and cross members, but also upon most of the grate proper, as well as upon the bottom surface of the grate cover, all of which again frustrated the objectives of the employment of the grate cover in the first place.

According to the present invention, the unsuggested structural characteristics and properties of the grate covers of the present invention eliminate the shortcomings of and objections to the prior-art devices in actual practice and provide a more environmentally-acceptable solution to the problem of the collection of paint spray particles and the like on paint spray booth grates as documented in U.S. Pat. No. 4,770,089.

OBJECTS OF THE INVENTION

It is an object of the present invention to provide an improved temporary disposable paint spray area grate cover and especially such a cover which is positively blocked against lifting of the cover off the grate by the provision of built-in protuberances in skirts of the cover itself, and which is otherwise free of the objectionable characteristics or features of prior-art structures of a similar nature, as enumerated in the foregoing.

Additional objects of the invention will become apparent as the description proceeds and still others will be obvious to one skilled in the art.

SUMMARY OF THE INVENTION

The invention; then, inter alia, comprises the following, alone or in combination:

An improved cover for paint spray area grates, including grates of the type having perimeter blades bounding the perimeter of the grate, plural grate blades running in spaced parallel direction along one dimension of the grate and plural grate cross members extending transversely to the grate blades, comprising:

means for shielding the grate blades and grate cross members from paint particles entrained in air drawn down through the grate and for facilitating installation of the cover on the grate without substantially inhibiting air flow down through the grate, such means comprising a lightweight plastic one piece member having:

a top wall comprising perimeter portions integral with plural length and width cross portions bounding a plurality of openings substantially coextensive with corresponding openings in the grate to be covered, skirts depending into said openings from said perimeter portions, length cross portions and width cross portions, parts of said skirts adjacent said top wall being positioned close to the top of the grate blades and grate cross members, a pair of said skirts flanking each grate blade and cross member, each said pair of flanking skirts being downwardly divergent so that the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof so that said skirts form a continuous perimeter wall for such opening, wherein width cross portions of the cover which extend downwardly below the bottom of the corresponding grate cross members are provided with built-in protuberances which are adapted to abut the bottom of the corresponding grate cross members, thereby to lock or clamp the corresponding skirts against a portion of the underside of the grate cross members and thereby positively to block lifting of the cover off of the grate by means of said built-in protuberances; such a cover wherein protuberances provided at opposite sides of the longitudinal centerline of the grate cover are pointed in opposite directions so as more positively to block lifting of the cover off of the grate; such a cover wherein said protuberances are pointed toward each other and toward a central portion of said grate cover; such a cover wherein said protuberances are absent from or reduced in density on skirts in the central portion of said grate cover on or adjacent to said centerline; and such a cover wherein the lower edges of the skirt members are located below the bottom edges of underlying grate blades.

Moreover, a cover for paint spray area grates, including grates of the type having perimeter blades bounding the perimeter of the grate, plural grate blades running in spaced parallel direction along one dimension of the grate and plural grate cross members extending transversely to the grate blades, comprising:

a lightweight, molded plastic, one piece member having:

(1) means for shielding the top of said blades and grate cross members from paint particles settling thereon, the latter means defining a top wall comprising perimeter portions integral with plural length and width cross portions bounding a plurality of openings substantially coextensive with corresponding openings in the grate to be covered, and (2) means for shielding the sides of said blades and grate cross members from sticky paint particles entrained in air drawn down through the grate, the latter means defining skirts depending into said openings from said perimeter portions and length cross portions and width cross portions, a pair of said skirts flanking each grate blade and cross member, each said pair of flanking skirts being downwardly divergent so that the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof such that said skirts form a continuous perimeter wall for such opening, wherein the lower edges of the skirt members are located below the bottom edges of the underlying grate blades and wherein width cross portions of the cover which extend downwardly below the bottom of the corresponding grate cross members are provided with built-in protuberances which are adapted to abut the bottom of the corresponding grate cross members, thereby to lock or clamp the corresponding skirts against a portion of the underside of the grate cross members and thereby positively to block lifting of the cover off of the grate by means of said built-in protuberances; such a cover wherein protuberances provided at opposite sides of the longitudinal centerline of the grate cover are pointed in opposite directions so as more positively to block lifting of the cover off of the grate; such a cover wherein said protuberances are pointed toward each other and toward a central portion of said grate cover; and such a cover wherein said protuberances are absent from or reduced in density on skirts in the central portion of said grate cover on or adjacent to said centerline.

BRIEF DESCRIPTION OF THE DRAWINGS

Reference is now made to the drawings wherein.

DETAILED DESCRIPTION OF THE INVENTION

Referring now more particularly to the drawings, wherein all the parts are numbered and wherein the same or similar numbers are employed to referred to the same or similar parts throughout:

The grate cover of the present invention is designed to be applied to a typical paint spray grate as employed in typical paint spray booths having such grates to define the floor of the spray booth. Such conventional grates are typically of steel and comprise parallel spaced longitudinal blades of flat bar stock, arranged with width vertical and thickness horizontal. To the blades are welded spaced, parallel cross-members of round rod stock, generally flush with the tops of the blades, the blades and cross-members forming a uniform open work grid, the perimeter of which is defined generally by a plurality of perimeter blades. A typical spray booth floor has four (4) rows of grates, which rows extend the length of the grate area of the paint spray booth and, again typically, the grates are approximately one foot wide by five feet long and up to about two inches in height. As well known, the length of the paint spray booth in a typical plant employing spray painting may require as many as four hundred or five hundred grates. Such grates are typically and representatively depicted in FIGS. 1 and 2 of U.S. Pat. No. 4,770,089, but are so well known in the art that further depiction thereof for purposes of defining and claiming a temporary cover therefor is submitted to be unnecessary.

Figure 1:
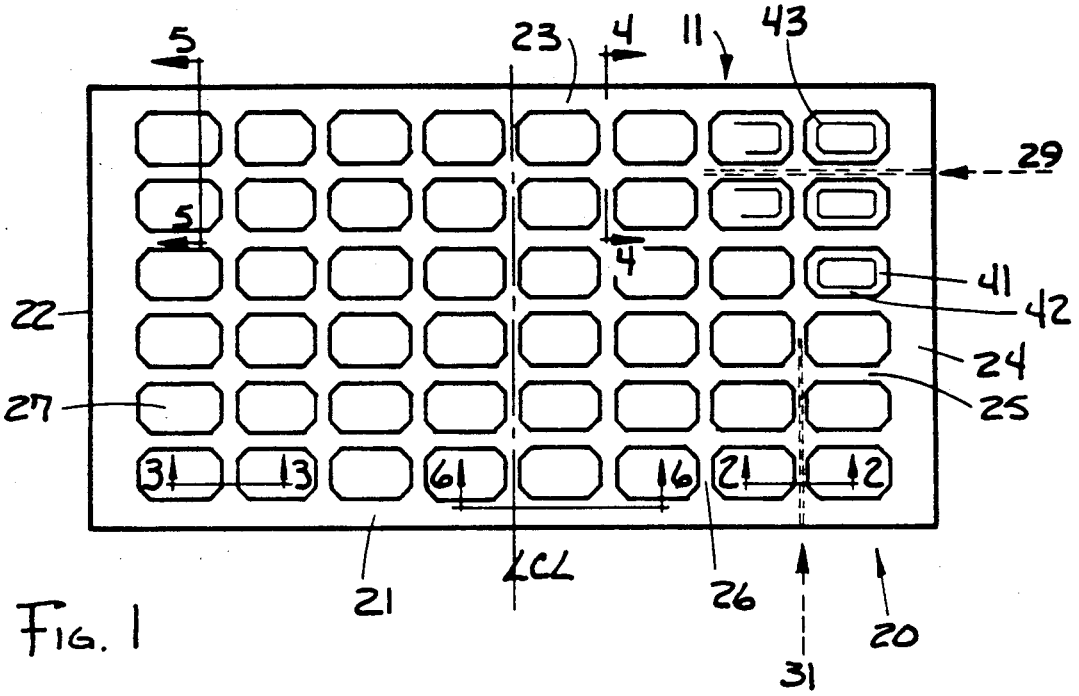
FIG. 1 is a top plan view of a grate cover according to the present invention in place atop a conventional paint spray booth grate (not shown).

For purposes of the present invention, FIG. 1 shows a top plan view of the grate cover of the invention, below which is to be understood as situated a typical paint spray booth grate. The grate blades are identified in the drawings hereof by the numeral 30 and the grate cross-members are identified herein by the number 32. Aside from the fact that the blades 30 of the conventional grate extend parallelly and longitudinally, and that the cross-members 32 extend parallelly and across the grate transversely rather than longitudinally, further depiction or identification of the grate or the grate members is submitted to be unnecessary for purposes of further and adequately describing the grate cover.

The grate cover of the present invention, like that of U.S. Pat. No. 4,770,089, has widthwise skirts 41 and lengthwise skirts 42, defining openings 27, and preferably all skirts are of the same depth. The skirts join at the four corners 43 of each opening, so that each opening 27 has a closed perimeter defined by the skirts 41 and 42 and corners 43 where they join. Accordingly, the arrangement of skirts 41 and 42 of the cover 11 provides downwardly-opening longitudinal and widthwise or cross-channels 29 and 31, respectively adapted to receive the grate blades 30 and grate cross-members 32. The tops of channels 29 and 31 are generally sufficiently narrow so as to snugly engage the tops of the grate blades 30 and cross-members 32, respectively, so that the grate cover 11 does not tend to shift or slide horizontally on the grate. It will be understood by one skilled in the art that the cover may have perimeter portions which correspond substantially in width to the width of the grate perimeter blades, and so that the outer faces of the grate perimeter blades will be flush with the outer edges of the cover perimeter portions. However, cover perimeter portions can also be widened or extended, if desired, so as to overlap the perimeter area of adjacent grate covers, as again will be apparent to one skilled in the art.

Now, referring more specifically to the drawings, FIG. 1 shows the typical cover 11 having a top wall 20 comprising perimeter portions 21, 22, 23, and 24, all integral with length and width cross-portions 25 and 26, bounding a plurality of grate cover openings 27, essentially coextensive with corresponding openings in an underlying grate (not shown). The grate cover 11 is dimensioned so that its marginal portion 21–24, length cross portions 25, and width cross portions 26, respectively and substantially coextensively cover the top surfaces of the perimeter blades (not shown), longitudinal grate blades 30, and grate cross-members 32 of the underlying grate. Underlying longitudinal and cross-channels 29 and 31 are indicated by shadow lines.

Integrally dependent from the cover top wall 20 into openings 27 are widthwise and lengthwise skirts 41 and 42. More particularly, the widthwise and lengthwise skirts 41 and 42 depend respectively from the length and width cross portions 25 and 26 of cover top wall 20. Skirts 41 and 42 are preferably slightly angled away from the vertical, in a direction away from the respective grate blade 30 and cross-member 32 which they protect, and the angles at which they vary from the vertical are now conventional so that the cover can be considered steeply funnel-shaped with respect to each opening 27 therein.

Figure 2:
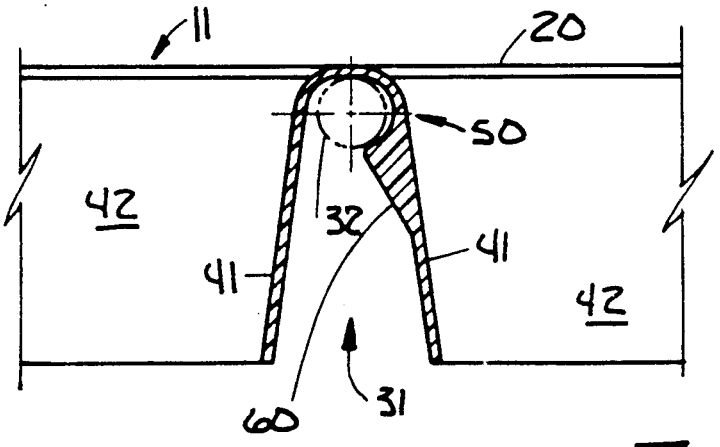
FIG. 2 is a cross-sectional view thereof along line 2—2 of FIG. 1 showing a grate cross member and the clamping structure of the grate cover of the invention at the right side thereof.

Referring now more particularly to FIG. 2, this FIG. shows the longitudinal side walls 42 of the skirts and the crosswise sidewalls 41 of the skirts, as well as cover top wall 20 comprising integral parts of grate cover 11. Crosswise channel 31 provides a snug fit at its top with cross-member 32 of the grate, and the sidewall of widthwise skirt 41 comprises also protuberance 60 which, as noted, is a width cross portion of the cover extending downwardly below the bottom of grate cross-member 32, which built-in protuberance 60 is adapted to abut the bottom of the corresponding grate cross-member 32, thereby to lock or clamp and thus releasably secure the skirt against a portion of the underside of the grate cross-member 32 for positively blocking the lifting of the cover off of the grate by means of the built-in protuberance 60.

Figure 3:
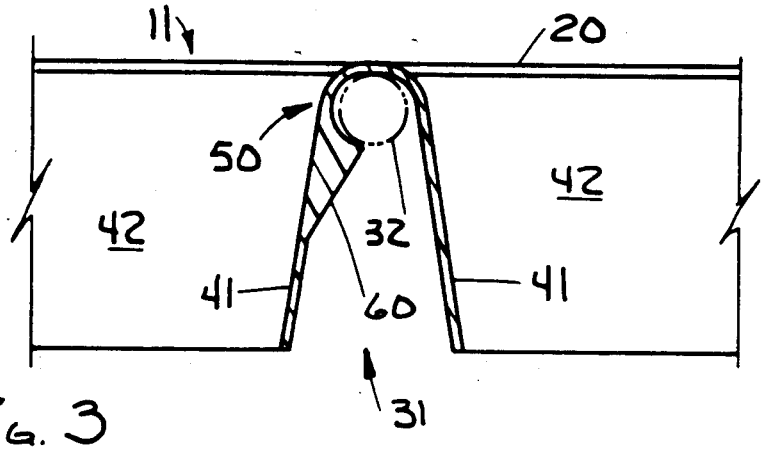
FIG. 3 is a cross-sectional view thereof along line 3—3 of FIG. 1 showing the same thing at the other (left) side of the longitudinal centerline of the grate cover.

FIG. 3 shows the same thing, but with the protuberance 60 forming a part of the skirt on the opposite side of the centerline of the cover, pointed in the opposite direction, thereby more positively to block lifting of the cover off of the grate, when taken in conjunction with the same type of built-in protuberance on the other side of the centerline of the cover.

Figure 4:
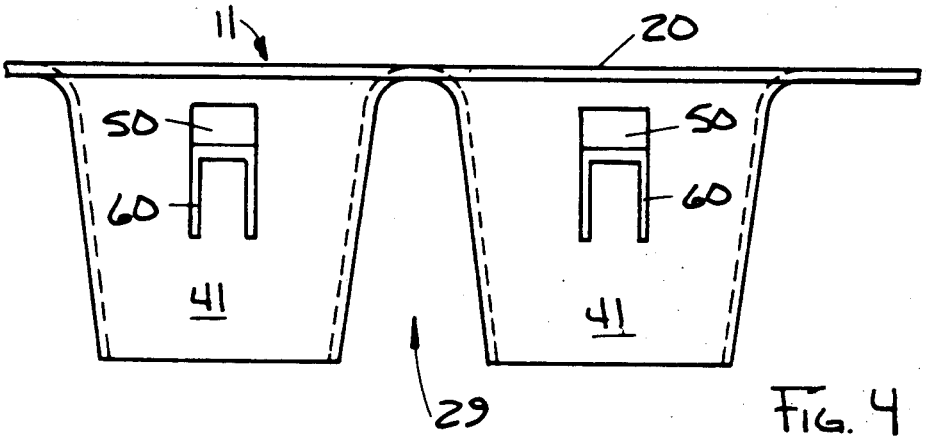
FIG. 4 is a cross-sectional view of a grate cover of the invention along line 4—4 of FIG. 1.

From FIG. 4, looking in the opposite direction, the protuberance 60, which abuts the bottom of the corresponding grate cross-member 32, and the upper portion of the skirt wall or protuberance 50 which provides a suitable aperture for partial enclosure of grate cross-member 32, are visible. Whether protuberances 60 are pointed toward each other or away from each other on opposite sides of the longitudinal centerline of the cover 11 is immaterial except that, from experience in actual practice, the pointing of the protuberances 60 toward each other and toward the central portion and/or toward the longitudinal centerline of the cover 11 is preferred for ease of installation and removal of cover 11.

Figure 6:
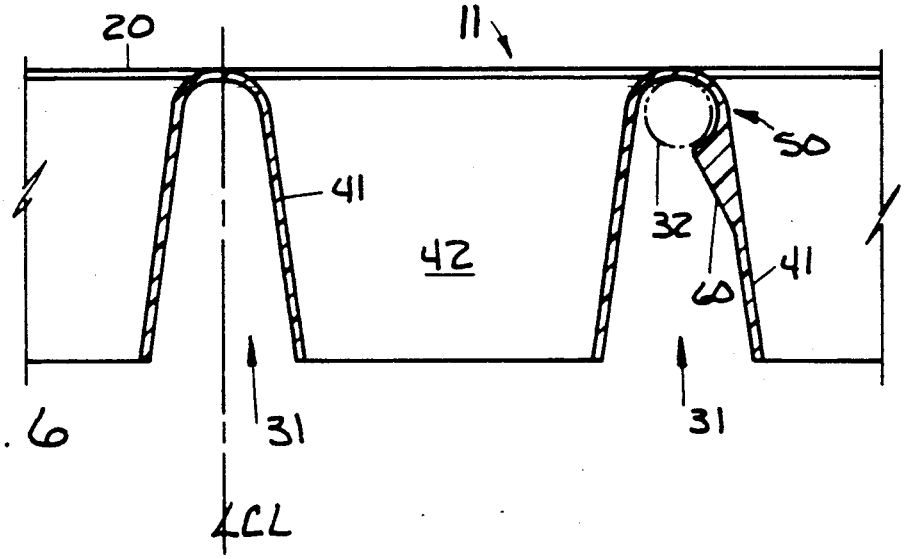
FIG. 6 is a cross-sectional view along the middle cross-channel or longitudinal centerline of the grate cover of the invention, as well as the adjacent row as in FIG. 2, but also showing the absence of grate cross member clamping protuberances from the skirt of the grate cover along the centerline or middle cross-channel.

In addition, as shown in FIG. 6, it is preferred, also for ease of removal of the cover 11, that protuberances 60 be absent from or at least reduced in density, i.e., in number, on the skirts in cross-channels 31 in the central portion of the cover, that is, at least in the most central cross-channel 31 of cover 11 which straddles the longitudinal centerline of the cover, and in some cases also in one or more adjacent cross-channels, so as to facilitate more readily the installation and removal of the grate cover, regardless of the direction in which the protuberance 60 may be facing on either or both sides of the longitudinal centerline of the cover 11. In addition, the protuberances 60 may be staggered along the cross-channels 31 and need not be on every skirt 41 in every cross-channel 31, one protuberance every 2 or 3 skirts sometimes being sufficient for the necessary clamping or locking effect with respect to grate cross members 32.

Figure 5:
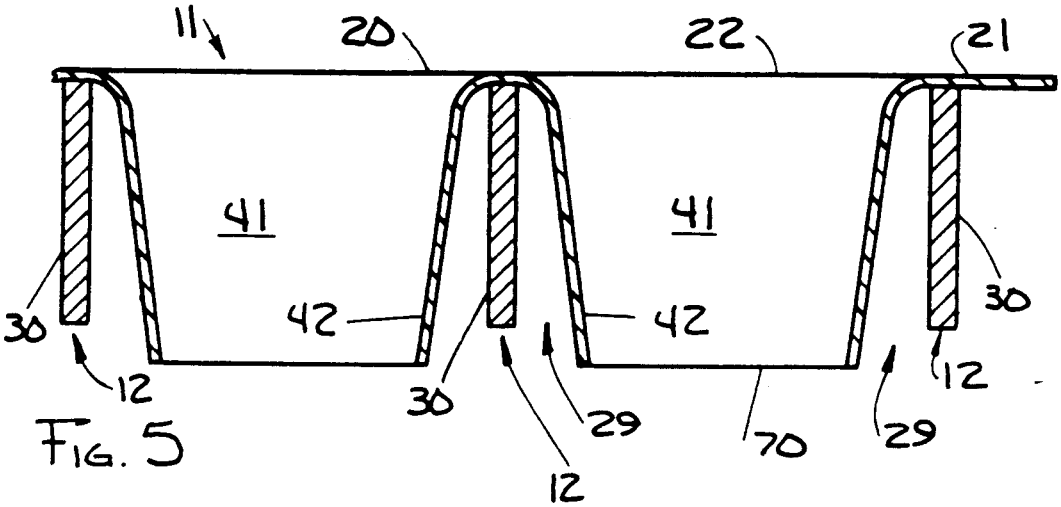
FIG. 5 is a cross-sectional view along line 5—5 of FIG. 1 showing a grate blade with skirts of the grate cover of the invention extending below the bottom edge thereof.

Finally, as shown in FIG. 5, it is important that the lower edges of the skirt members 70 are located below, e.g., one-thirty second (1/32) to about one-eighth (⅛) inch below, the bottom edges of the underlying grate blades 12, since such structure, as previously pointed out, has unexpectedly been found in practice to be much preferable and even essential from the standpoint of a satisfactory and maximally-efficient operation of the grate cover of the present invention.

The grate cover of the invention is therefore a lightweight, molded plastic, one-piece member which, as usual, can be made from any readily-available economical plastic composition which can be injected or extruded into a mold which will form the inventive grate cover. Examples of acceptable thermoplastic compositions, e.g., which can be softened or melted and then formed into the inventive grate cover, are low-pressure polyethylene compositions which form relatively tough impact-resistant surfaces which can be easily cut and bent or molded when hot to form the required grate cover top, openings and skirts having the desired flared configuration. Other plastic compositions or formulations include polyethylene glycol terephthalate polyester sheets, such as clear plastic sheets, approximately 0.040 inch thick, sold by Sheffield Plastics under the trade name "VIVAK" polyester. It is preferred to use a plastic composition which, when formed into the desired grate cover, is both essentially static resistant (that is, conductive to static electric charges) as well as otherwise environmentally and safety acceptable for paint spray booth use applications. When polypropylene or a copolymer of propylene with another compatible monomer, usually included for flow enhancement, and preferably also with an anti-static agent, is employed, commercially-available granules thereof are utilized and subjected to heat in a closed mold according to conventional procedure.

In conclusion, from the foregoing, it is apparent that the present invention provides an improved temporary grate cover for paint spray booth areas which is positively self-blocking against inadvertent lifting of the cover off of the grate to which it is adapted to be attached for shielding purposes by virtue of built-in protuberances built into skirt cross portions or members for engagement of width cross portions of the grate, as well as such covers wherein the protuberances at opposite ends or sides of the cover are pointed in opposite directions so as to further positively block lifting of the cover off of the grate, as well as such a cover wherein lower edges of the skirt members are located below the bottom edges of the underlying grate blades, all providing the foregoing enumerated characteristics and advantages over similar prior art structures.

It is to be understood that the invention is not to be limited to the exact details of construction, operation, or to the exact materials of construction, compositions, methods, procedures, or embodiments shown and described, as obvious modifications and equivalents will be apparent to one skilled in the art, so that the invention is to be understood as limited only by the full scope which can be legally accorded the appended claims.

I claim:

1. An improved cover for paint spray area grates, including grates of the type having perimeter blades bounding the perimeter of the grate, plural grate blades running in spaced parallel direction along one dimension of the grate and plural grate cross members extending transversely to the grate blades, comprising:

means for shielding the grate blades and grate cross members from paint particles entrained in air drawn down through the grate and for facilitating installation of the cover on the grate without substantially inhibiting air flow down through the grate, such means comprising a lightweight plastic one piece member having:

a top wall comprising perimeter portions integral with plural length and width cross portions bounding a plurality of openings substantially coextensive with corresponding openings in the grate to be covered, skirts depending into said openings from said perimeter portions, length cross portions and width cross portions, parts of said skirts adjacent said top wall being positioned close to the top of the grate blades and grate cross members, a pair of said skirts flanking each grate blade and cross member, each said pair of flanking skirts being downwardly divergent so that the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof so that said skirts form a continuous perimeter wall for such opening, wherein width cross portions of the cover which extend downwardly below the bottom of the corresponding grate cross members are provided with built-in protuberances which are adapted to abut the bottom of the corresponding grate cross members, thereby to lock or clamp the corresponding skirts against a portion of the underside of the grate cross members and thereby positively to block lifting of the cover off of the grate by means of said built-in protuberances.

2. The cover of claim 1 wherein protuberances provided at opposite sides of the longitudinal centerline of the grate cover are pointed in opposite directions so as more positively to block lifting of the cover off of the grate.

3. The cover of claim 2 wherein said protuberances are pointed toward each other and toward a central portion of said grate cover.

4. The cover of claim 1 wherein the lower edges of the skirt members are located below the bottom edges of the underlying grate blades.

5. The cover of claim 2 wherein protuberances are absent from or reduced in density on skirts in the central portion of said grate cover on or adjacent to said centerline.

6. A cover for paint spray area grates, including grates of the type having perimeter blades bounding the perimeter of the grate, plural grate blades running in spaced parallel direction along one dimension of the grate and plural grate cross members extending transversely to the grate blades, comprising:

a lightweight, molded plastic, one piece member having:

(1) means for shielding the top of said blades and grate cross members from paint particles settling thereon, the latter means defining a top wall comprising perimeter portions integral with plural length and width cross portions bounding a plurality of openings substantially coextensive with corresponding openings in the grate to be covered, and (2) means for shielding the sides of said blades and grate cross members from sticky paint particles entrained in air drawn down through the grate, the latter means defining skirts depending into said openings from said perimeter portions and length cross portions and width cross portions, a pair of said skirts flanking each grate blade and cross member, each said pair of flanking skirts being downwardly divergent so that the space between the bottom edges of such pair of skirts is wider than the space between the top edges of said skirts, the skirts bounding each opening defining a steep funnel shape such that said opening has a somewhat larger area at the top than at the bottom thereof, the skirts in each opening being connected at the corners thereof such that said skirts form a continuous perimeter wall for such opening, wherein the lower edges of the skirt members are located below the bottom edges of the underlying grate blades and wherein width cross portions of the cover which extend downwardly below the bottom of the corresponding grate cross members are provided with built-in protuberances which are adapted to abut the bottom of the corresponding grate cross members, thereby to lock or clamp the corresponding skirts against a portion of the underside of the grate cross members and thereby positively to block lifting of the cover off of the grate by means of said built-in protuberances.

7. The cover of claim 6 wherein protuberances provided at opposite sides of the longitudinal centerline of the grate cover are pointed in opposite directions so as more positively to block lifting of the cover off of the grate.

8. The cover of claim 7 wherein said protuberances are pointed toward each other and toward a central portion of said grate cover.

9. The cover of claim 7 wherein said protuberances are absent from or reduced in density on skirts in the central portion of said grate cover on or adjacent to said centerline.

* * * * *